US009596913B2

(12) United States Patent
Thompson

(10) Patent No.: US 9,596,913 B2
(45) **Date of Patent: *Mar. 21, 2017**

(54) EXPANDABLE BACKPACK SYSTEM

(71) Applicant: Eddie Bauer LLC, Bellevue, WA (US)

(72) Inventor: Jesse Brian Thompson, North Bend, WA (US)

(73) Assignee: Eddie Bauer LLC, Bellevue, WA (US)

( * ) Notice: Subject to any disclaimer, the term of this patent is extended or adjusted under 35 U.S.C. 154(b) by 47 days.

This patent is subject to a terminal disclaimer.

(21) Appl. No.: 14/884,970

(22) Filed: Oct. 16, 2015

(65) Prior Publication Data

US 2016/0029758 A1 Feb. 4, 2016

Related U.S. Application Data

(63) Continuation of application No. 13/847,372, filed on Mar. 19, 2013, now Pat. No. 9,173,462.

(60) Provisional application No. 61/612,757, filed on Mar. 19, 2012.

(51) Int. Cl.

| | |
|---|---|
| ***A45F 4/02*** | (2006.01) |
| ***A45C 7/00*** | (2006.01) |
| ***A45F 3/04*** | (2006.01) |

(52) U.S. Cl.

CPC ..... *A45C 7/0063* (2013.01); *A45C 7/0022* (2013.01); *A45F 3/04* (2013.01)

(58) Field of Classification Search

CPC ..... A45C 7/0022; A45C 5/14; A45C 7/0063; A45C 7/0031; A45C 7/0027

USPC ..... 190/103, 100, 44, 107, 105; 224/627, 224/651, 655, 153; 383/16

See application file for complete search history.

(56) References Cited

U.S. PATENT DOCUMENTS

| | | | | |
|---|---|---|---|---|
| 4,153,146 | A * | 5/1979 | Patton | A45C 7/0068 190/103 |
| 4,506,769 | A * | 3/1985 | Franco | A45C 3/00 16/DIG. 40 |
| 4,648,121 | A * | 3/1987 | Lowe | A45F 3/04 224/259 |
| 5,012,964 | A * | 5/1991 | Falletta | B63C 11/26 224/153 |
| 6,015,072 | A * | 1/2000 | Young | A45C 7/0063 190/103 |
| 6,029,877 | A * | 2/2000 | Woods | A45C 13/02 224/236 |
| 6,290,114 | B1 * | 9/2001 | Berberian | A45F 3/04 224/637 |
| D615,757 | S * | 5/2010 | Kostner | D3/244 |
| 7,909,150 | B2 * | 3/2011 | Mangano | A45C 3/06 150/103 |
| 8,302,749 | B2 * | 11/2012 | Melmon | A45C 11/38 150/103 |
| 8,870,045 | B1 * | 10/2014 | Aguirre | A45F 3/04 224/581 |

(Continued)

*Primary Examiner* — Fenn Mathew
*Assistant Examiner* — Cynthia Collado
(74) *Attorney, Agent, or Firm* — Sheridan Ross P.C.

(57) ABSTRACT

Expandable luggage devices are provided. Included within expandable luggage devices is an expandable backpack that is convertible between at least two positions. An uppermost cover portion of the backpack converts to a side or back portion when the backpack is expanded, and a secondary cover portion is withdrawn from an internal area of the device to enclose or cover the backpack in the second position.

19 Claims, 6 Drawing Sheets

(56) References Cited

U.S. PATENT DOCUMENTS

| | | | | |
|---|---|---|---|---|
| 2011/0186611 | A1* | 8/2011 | Eberle | A45F 3/04<br>224/583 |
| 2013/0180816 | A1* | 7/2013 | Wytenhove | A45C 5/03<br>190/103 |

* cited by examiner

EXPANDABLE BACKPACK SYSTEM

This Non-Provisional Application is a Continuation of and claims the benefit of priority from U.S. patent application Ser. No. 13/847,372, filed Mar. 19, 2013, which claims the benefit of priority from U.S. Provisional Patent Application No. 61/612,757, filed Mar. 19, 2012, the entire disclosures of which are hereby incorporated by reference in their entireties.

FIELD OF THE INVENTION

The present disclosure generally relates to luggage. More specifically, the present disclosure relates to an expandable system for luggage items, and particularly for backpacks.

SUMMARY OF THE INVENTION

An expansion system for a luggage item, particularly a backpack, is provided. In various embodiments, the system comprises an enclosure system for maintaining and securing items, a zipper or similar fastener for providing a temporary seal, and an expansion portion. The expansion portion resides generally within the pack when the pack is in a first un-expanded state. In a second expanded state, the expansion portion extends upwardly and outwardly from an internal volume of the pack to create a second, larger internal volume.

The pack comprises a first upper cover portion in a first, compressed state. When the pack is expanded from a first internal volume to a second, larger internal volume, the upper sealing member is moved generally outwardly and transitions to an outer-side member. The expansion portion is drawn upwardly and a second upper cover portion, previously residing within the first storage volume, is drawn out of the pack and provides cover for an upper portion of the pack in the second, expanded state.

The second upper cover portion, in various embodiments of the present disclosure, comprises a portion that is generally not in use when the bag is arranged in a first, compressed state. In preferred embodiments, the second upper cover portion may reside within a first storage volume. In alternative embodiments, the second upper cover portion resides along an outer side portion of the pack and may be secured thereto by various fasteners.

Luggage items of the present invention comprise various enclosure and carrying systems as will be recognized by one of skill in the art. Such enclosure and carrying systems comprise, for example, zippers, snaps, buckles, cords, adjustable straps, padded, ventilated padding, a plurality of pockets, elastic securing portions, reflective features, etc.

In one embodiment, a luggage device is provided comprising a main storage area interchangeable between at least a first and second position of use, the first position of use comprising a first internal storage volume and a second internal storage volume, the first internal storage volume being less than the second internal storage volume. A plurality of straps are interconnected to the main storage area for securing the device to a user. The first position of use comprises a cover portion at least partially formed by a zipper interconnecting a front panel and a rear panel of the device. A secondary cover portion and an expandable sleeve portion are provided and reside substantially within the first internal volume at least when the device is provided in the first position of use. The second position of use is characterized in that the secondary cover portion and said expandable sleeve portion are drawn upwardly and external to said first internal storage volume to create said second internal volume. The secondary cover portion is interconnected to the main storage area by at least one adjustable flexible strap member.

The Summary is neither intended nor should it be construed as being representative of the full extent and scope of the present disclosure. The present disclosure is set forth in various levels of detail in the Summary as well as in the attached drawings and the Detailed Description and no limitation as to the scope of the present disclosure is intended by either the inclusion or non-inclusion of elements, components, etc. in this Summary. Additional aspects of the present disclosure will become more readily apparent from the Detailed Description, particularly when taken together with the drawings.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of the disclosures.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

DETAILED DESCRIPTION

While preferred embodiments of the present disclosure comprise expansion systems for backpacks, it will be expressly recognized that the present disclosure is not so limited. Indeed expansion systems and features of the present disclosure may be provided in any number of luggage items, including, but not limited to duffels, shoulder bags, messenger bags, satchels, attaches, etc.

As used herein, the terms "compressed" and "expanded" are relative terms and should not be read or interpreted as limiting or as connoting any particular arrangement or device other than in their relative sense.

Figure 1:
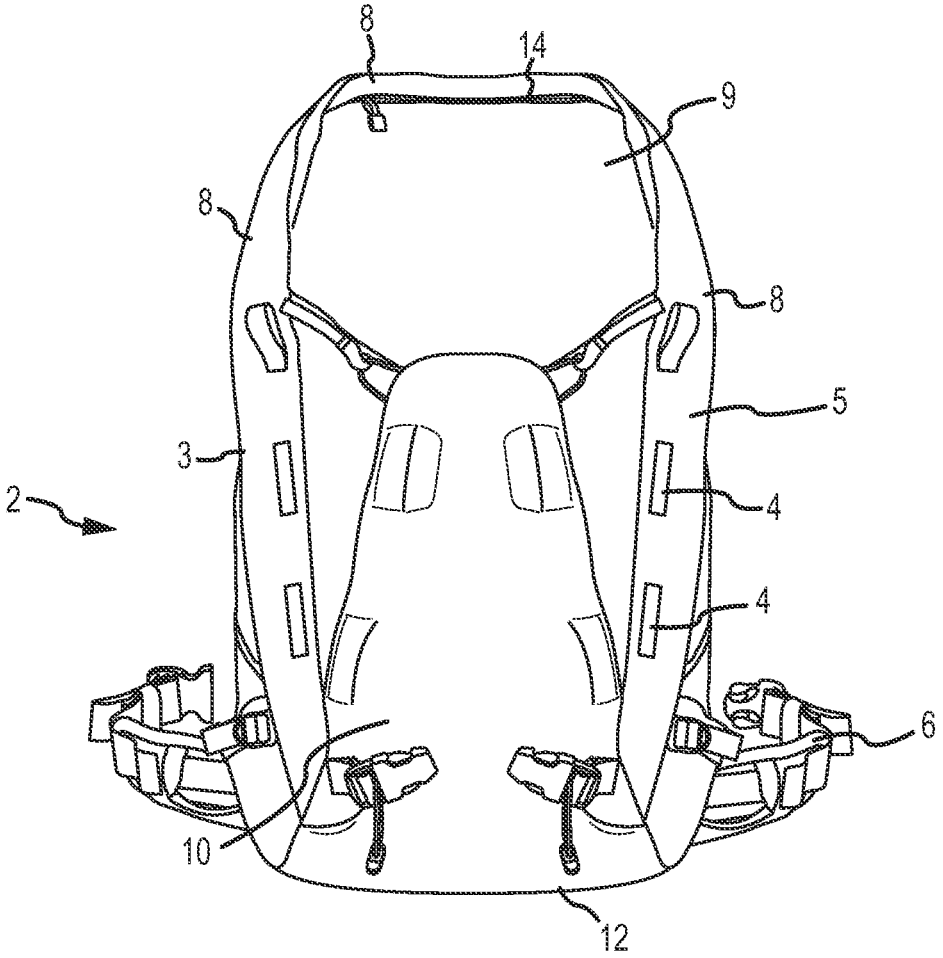
FIG. 1 is a perspective view of one embodiment of the luggage item.

Referring now to FIG. 1, a front perspective view of one embodiment of the invention is shown. As depicted, a luggage item comprises a backpack 2. The backpack 2 comprises various features 4, including attachment straps, compression straps, padded or abrasion-resistive areas, and adjustments. Features may also comprise external pockets 6. Such features 4, 6 are useful for securing various items to an external portion of the bag 2, storing items such as water bottles where they are easy to access, and adjusting the shape or center of gravity of the bag. It will be recognized, however, that the luggage items of the present disclosure are not limited to any particular arrangement or number of such features 4. Indeed, items provided in accordance with the present invention may comprise any number, type, or arrangement of such features, or may be provided without such features.

As shown in FIG. 1, the backpack 2 generally comprises side portions 3, 5, an upper portion 9, a back portion 10, a bottom portion 12, and a top portion 14. Such portions may also be considered and/or provided as panels. It will be recognized, however, that as various embodiments of the present invention contemplate rounded or integrated bag structures, the backpack 2 is not limited to a design comprising discrete or separate panels. As shown, the bag 2 is provided in a closed position with an internal storage volume contained or closed by a primary zipper 8. Primary zipper 8 extends along a top portion of the backpack 2 and along at least a portion of the side panels 3, 5. In addition to allowing for selective closure of the internal storage area, the zipper 8 provides various features and benefits as shown and described herein.

Figure 2:
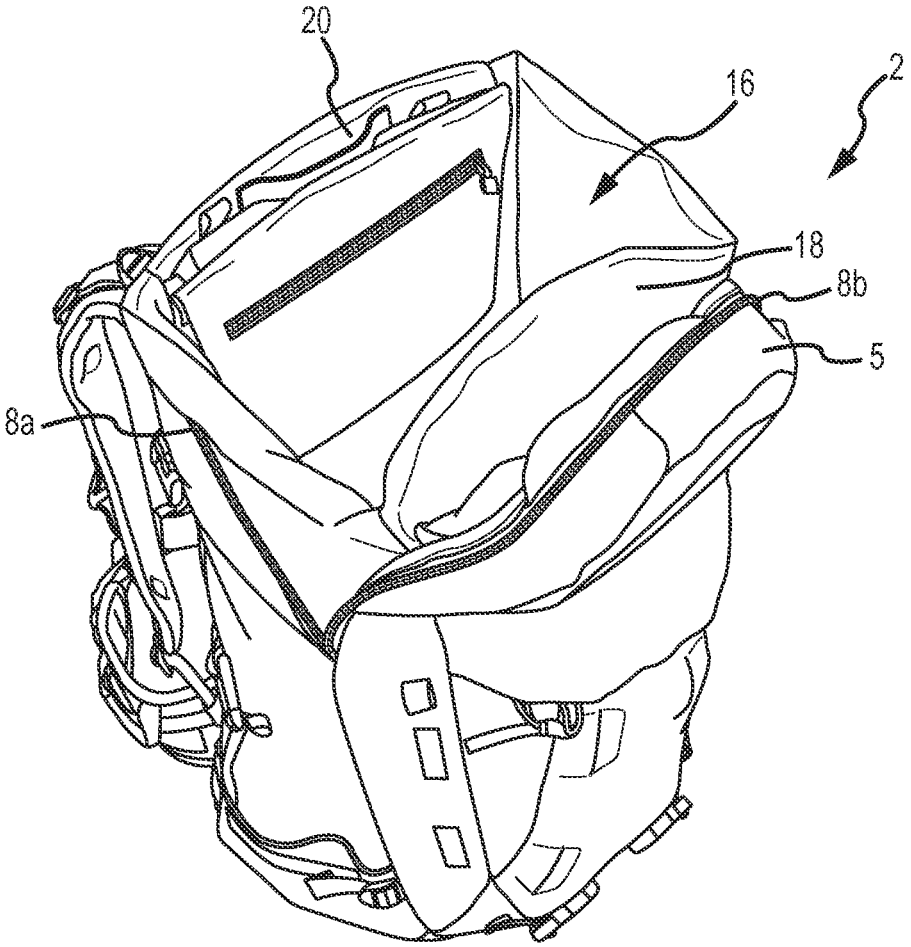
FIG. 2 is a perspective view of one embodiment of the luggage item in an open and collapsed position.

FIG. 2 depicts the backpack 2 in an open position wherein the zipper portion has been separated, revealing first and second zipper portions 8*a*, 8*b* and an internal storage area 16. In addition to providing a volume for storage and carriage of various items, internal storage area 16 further comprises means and features for extending the volume or useable space of the backpack 2. As shown, an expandable sleeve portion 18 is provided. As shown in FIGS. 1-2, the expandable sleeve portion 18 is provided in a packed or compressed state wherein the sleeve is positioned downwardly and substantially parallel to the sidewalls of the backpack 2. In such a position, the compressed or unused sleeve portion 18 is in a position of non-use wherein it occupies minimal space yet is available for expansion or deployment. The backpack 2 provided in FIGS. 1-2 generally comprises a "top-loading" bag. The zipper portion 8 extends along a top portion of the bag 2, but also extends vertically along both side portions 3, 5 of the backpack 2. Such vertical extension allows for the upper portion 9 and rear portion 10 to be moved outward, thus expanding the depth of the backpack 2 when the zipper 8 is open.

Figure 3:
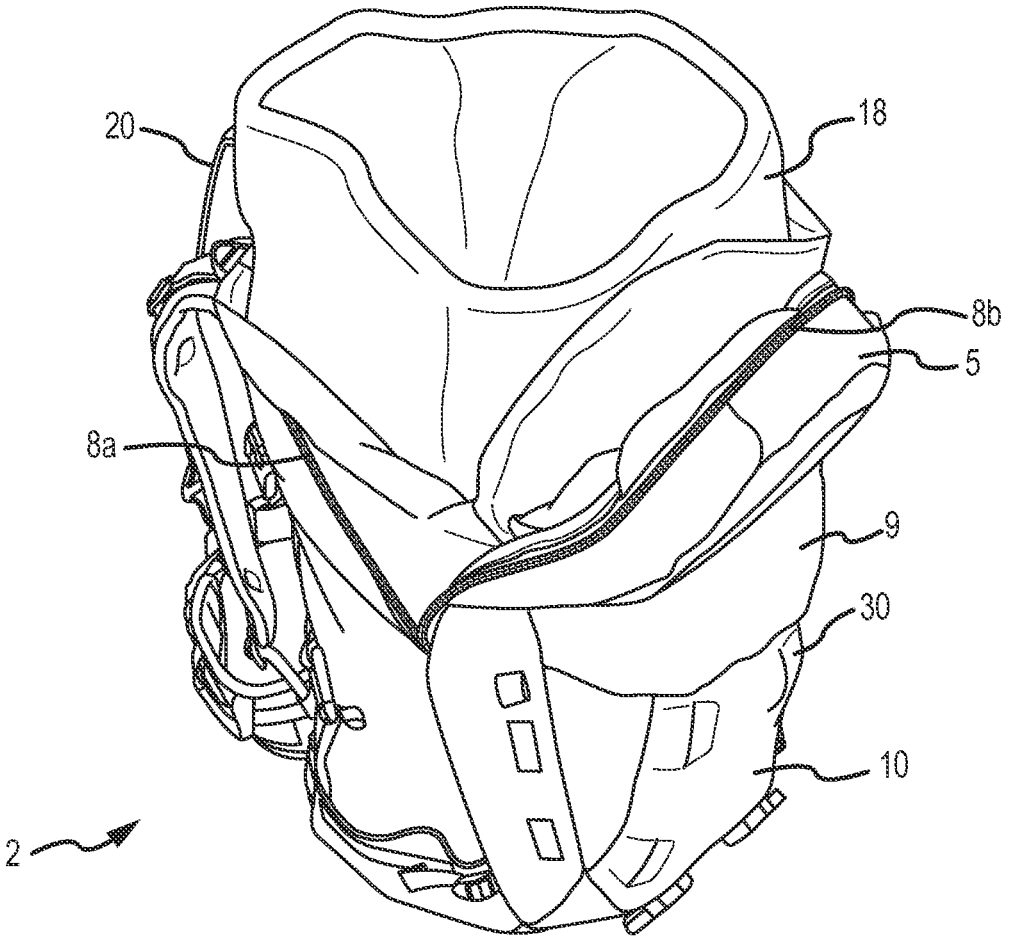
FIG. 3 is a perspective view of one embodiment of the luggage item in an open and partially expanded position.

As shown in FIG. 3, various embodiments of the present invention comprise an arcuate zipper 8, wherein the zipper extends vertically along at least a portion of the side portions 3, 5, comprises a diagonal portion extending toward the back portion 30, and extends laterally along the top portion of the backpack. A lid portion 20 is provided and shown in a packed or compressed state in FIG. 2 and partially deployed in FIG. 3. The lid portion 20, as shown and described in more detail herein, is provided in a position on non-use or storage when the backpack is in a first compressed state, and capable of being withdrawn and provided as a lid for the backpack when in an expanded state.

FIG. 3 depicts the expandable sleeve portion 18 withdrawn from the compressed or compacted state. Expandable sleeve portion 18 thus provides sidewall portion of the backpack in the expanded state. The expandable sleeve portion 18 is unrolled, unfolded, and/or stretched upwardly to form an additional storage volume for the backpack 2. The upper portion 9, which generally serves as a top cover portion in the compressed state, is now moved outwardly such that it has been effectively converted to a rear side panel or portion. Zipper portion 8*a* no longer defines the uppermost portion of the bag, but gives way to the sleeve 18 and cover 20.

Various embodiments of the present invention as shown and described herein comprise expandable top-loading backpacks expandable between a first state and a second state. In various embodiments the backpack is expandable between a first volume of between approximately 30 and 50 liters and approximately 51 and 60 liters. In one embodiment, a backpack is provided that is expandable between a first volume of between approximately 40 and 55 liters. It will be expressly recognized, however, that the present invention is not limited to a luggage device of a particular initial, compacted, or second, expanded state, or even to a luggage device that comprises two positions of use. Indeed, various luggage items are contemplated as being of various sizes and expansion characteristics. No limitation is provided or implied with respect to particular device sizes and/or storage volumes.

Figure 4:
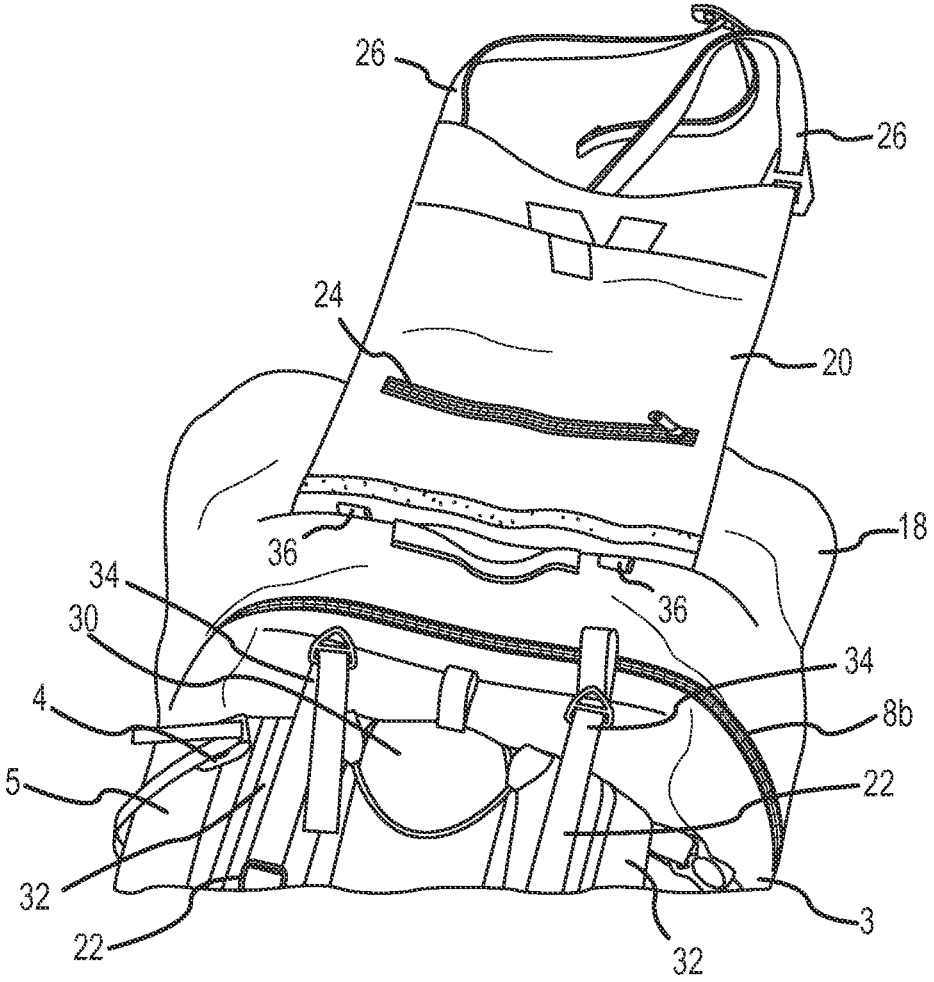
FIG. 4 is a perspective view showing certain features of a luggage item according to one embodiment of the present invention.

FIG. 4 is a rear perspective view of the backpack 2 in an expanded position. The cover 20 or lid for enclosing the pack in an expanded state is shown. The cover 20 comprises a substantially flexible portion that has been extended from an interior storage volume of the compacted or partially compacted state. In various embodiments, the cover 20 comprises an accessory pocket between sidewalls or panels of the cover 20, the accessory pocket being accessible by a zipper 24 or similar enclosing feature. The zipper 24 and associated pocket are accessible or operable in both compressed and expanded states of the pack 2. The cover 20 comprises securing means, shown as straps 26 in FIG. 4 for securing and closing the cover once the cover 20 is extended over the sleeve 18.

As shown in FIG. 4, zipper portion 8*b* is visible in a position of non-use associated with the expanded position of the pack. In the compacted or compressed state of FIG. 1, zipper portions 8*a*, 8*b* are secured and generally provided at a top portion of the backpack 2. In the expanded state illustrated in FIG. 4, the zipper portions 8*a*, 8*b* are separated such that they are substantially flush with front and back panels of the back, thereby allowing for extension of the sleeve 18 and cover 20 and conversion of the backpack 2 into an item with a larger storage volume.

Shoulder straps 32 are provided on a front portion of the pack 2 for securing the backpack 2 to a user. As shown, the shoulder straps 32 comprise securing members 22 to adjustably secure the backpack to the user. When the pack 2 is provided in an expanded state, with the sleeve 18 extended upwardly, securing members 22 may be selectively disconnected from a first position to a second position, wherein the members 22 are moved upwardly and secured to the additional height-wise storage volume to secure the additional storage volume and aid in restraining the pack and its moment of inertia proximal to a user, thus enhancing comfort, ergonomics and maneuverability.

Upper portions 34 of the securing members 22 are disconnectable from a first position and securing to loops 36 or similar features. Such transition and related adjustments prevent an upper portion of the backpack 2 from swinging or extending outwardly from a user to an unwieldy or undesired position.

Figure 5:
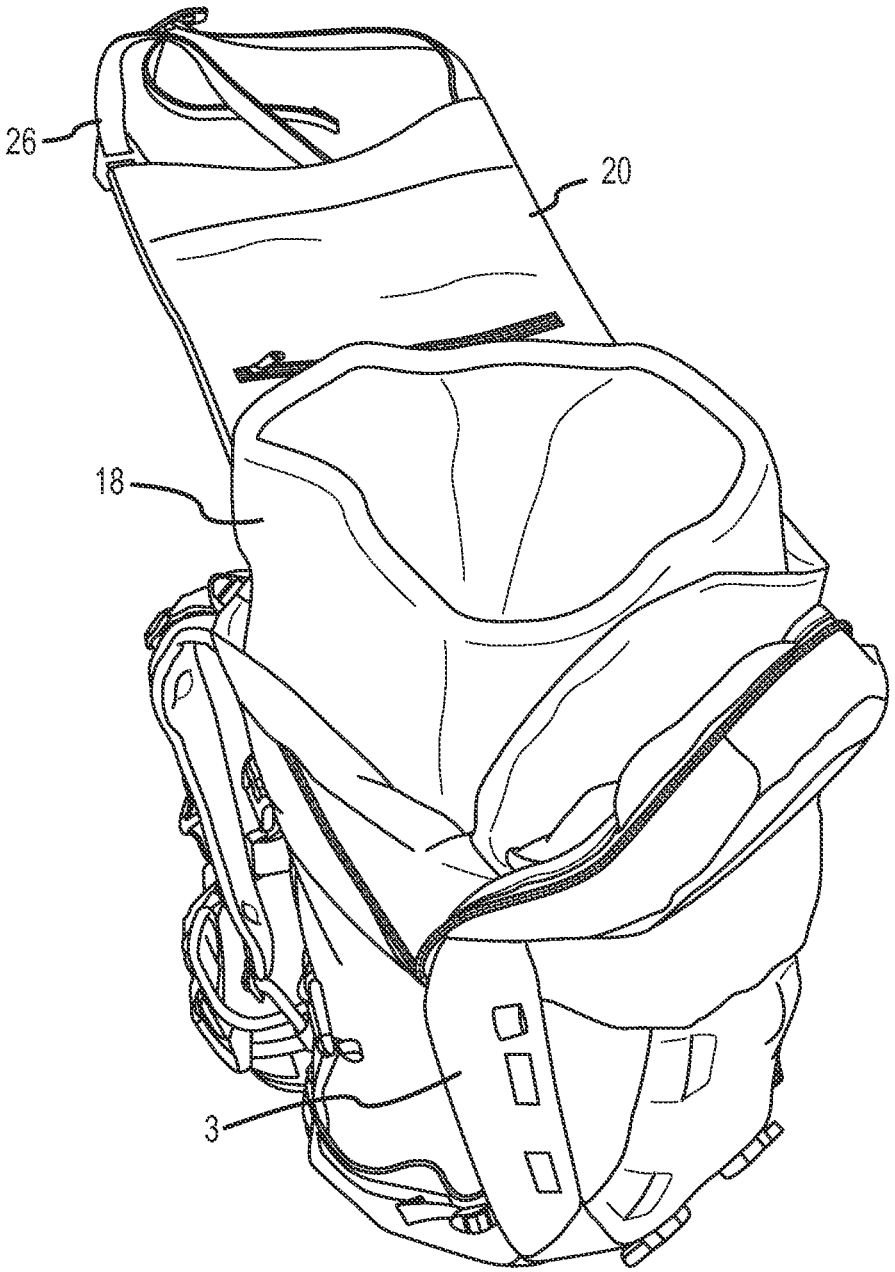
FIG. 5 is a perspective view showing certain features of a luggage item according to one embodiment of the present invention.
Figure 6:
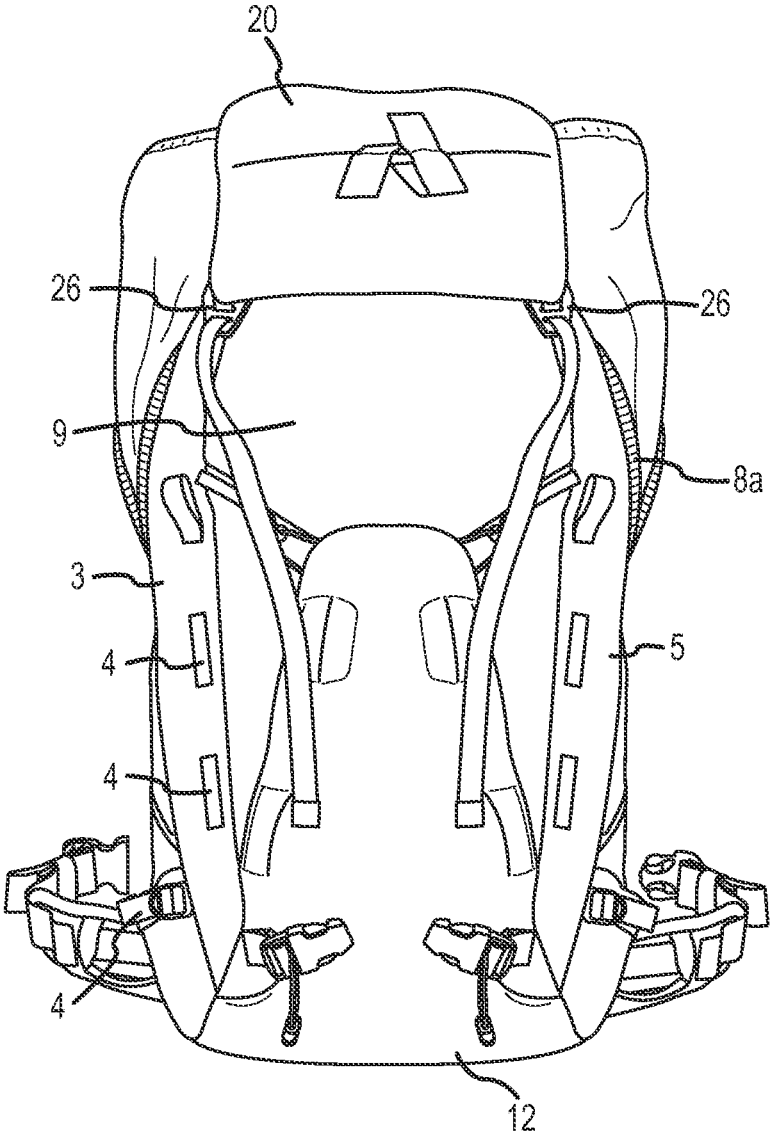
FIG. 6 is a perspective view of one embodiment of the luggage item in a closed and expanded position.

FIGS. 5-6 depict the backpack 2 as provided in an extended, open position and an extended, closed position, respectively. As shown, the zipper portions 8*a*, 8*b* are moved outwardly with respect to the compact position and allow for upward expansion of the sleeve portion 18, which creates an additional vertical-oriented storage area and a cover portion 20 to enclose the storage volume. As shown in FIG. 5, devices of the present invention comprise width or depth-wise expansion, as well as height-wise expansion. FIG. 5 shows one side portion 3 of the backpack 2, wherein the depth of the bag is expanded, at least in part due to the zipper extending down a portion of the side panel 3. Additional features, such as compression straps, pleats, and similar features are provided such that a luggage item 2 of the present disclosure is provided with the ability to expand and contract in at least two dimensions.

Various materials may be utilized in the construction of luggage items in accordance with the present invention. No limitation with respect to the same is expressed. It is contemplated that various rip-stop, waterproof, water-resistant, rubberized, abrasion-resistant, and similar materials as well as various combinations thereof be provided. It is further contemplated that various combinations of these materials be provided as may be required. For example, upper portions more likely to be subjected to precipitation are contemplated as comprising water resistant or waterproof materials, while lower and/or corner portion subject to additional stress or impact are provided with abrasion-resistant features.

While various embodiments of the present invention have been described in detail, it is apparent that modifications and alterations of those embodiments will occur to those skilled in the art. It is to be expressly understood that such modifications and alterations are within the scope and spirit of the present disclosure. Further, it is to be understood that the phraseology and terminology used herein is for the purposes of description and should not be regarded as limiting. The use of "including," "comprising," or "having" and variations thereof herein are meant to encompass the items listed thereafter and equivalents thereof, as well as, additional items.

What is claimed is:

1. A backpack selectively positionable between at least a first position of use and a second position of use, the backpack comprising:

a first volume and a first cover portion associated with the first position of use, the first cover portion comprising a zipper;

an expandable sleeve portion provided substantially within the first volume when the device is in the first position of use;

the second position of use comprising a second volume larger than the first volume, wherein the expandable sleeve portion at least partially defines the second internal volume;

a second cover portion comprising a panel member having a first end and a second end and at least one strap for securing and closing the device when the second cover portion is extended over the expandable sleeve portion;

wherein in the first position of use, the second cover portion is provided within the first volume, and wherein in the second position of use, the second cover portion comprises a cover for enclosing an upper portion of the expandable sleeve portion;

wherein the first end of said second cover portion is interconnected to said backpack, and the at least one strap comprises a securing strap for selectively securing the secondary cover portion and closing the backpack when the expandable sleeve portion is provided in the second position of use; and first and second shoulder straps connected to the device for supporting the weight of the backpack and its contents on a user.

2. The backpack of claim 1, wherein the first volume comprises a volume of between approximately 35 and 45 liters, and wherein the second volume comprises a volume of between approximately 50 and 60 liters.

3. The backpack of claim 1, wherein the first volume comprises a volume of between approximately 25 and 35 liters, and wherein the second storage volume comprises a volume of between approximately 35 and 45 liters.

4. The backpack of claim 1, wherein a panel portion of the backpack comprises a top panel portion when the backpack is provided in the first position of use and the panel portion comprises a rear panel portion when the backpack is provided in the second position of use.

5. The backpack of claim 1, wherein the first and second shoulder straps comprise a first end and a second end, each of said first ends and said second ends interconnected to said backpack.

6. A luggage device, comprising:

a main storage area selectively interchangeable between at least a first and a second position of use, the first position of use comprising a first internal storage volume, and the second position of use comprising a second internal storage volume;

the first internal storage volume being less than the second internal storage volume;

a plurality of shoulder straps provided on a front portion of the luggage device for securing the device to a user;

wherein at least one of the plurality of shoulder straps comprises a securing member operable to adjustably secure the luggage device to the at least one shoulder strap, the securing strap comprising an end that is selectively connectable at a first position and a second position;

a first cover portion comprising a zipper interconnecting a front panel and a rear panel of the device;

a secondary cover portion and an expandable sleeve portion, the secondary cover portion comprising a first end and a second end, the secondary cover portion connected to the expandable sleeve portion;

the second position of use characterized in that said secondary cover portion and said expandable sleeve portion are drawn upwardly and external to said first internal storage volume; and wherein said secondary cover portion is interconnected to said main storage area by at least one strap when the expandable sleeve portion is provided in the second position of use.

7. The luggage device of claim 6, wherein the luggage device comprises a backpack.

8. The luggage device of claim 6, wherein the first internal storage volume comprises a volume of between approximately 35 and 45 liters, and wherein the second internal storage volume comprises a volume of between approximately 50 and 60 liters.

9. The luggage device of claim 6, wherein the first internal storage volume comprises a volume of between approximately 25 and 35 liters, and wherein the second internal storage volume comprises a volume of between approximately 35 and 45 liters.

10. The luggage device of claim 6, wherein a panel portion of the luggage device comprises a top panel portion when the luggage device is provided in the first position of use and the panel portion comprises a rear panel portion when the luggage device is provided in the second position of use.

11. The luggage device of claim 6, further comprising first and second shoulder straps comprising a first end and a second end, each of said first ends and said second ends interconnected to said luggage device.

12. An expandable luggage device in the form of a backpack selectively positionable between at least a first position of use and a second position of use, the luggage device comprising:

a first volume and a first cover portion associated with the first position of use, the first cover portion comprising a zipper;

an expandable sleeve portion provided substantially within the first volume when the device is in the first position of use;

the second position of use comprising a second volume larger than the first volume, wherein the expandable sleeve portion at least partially defines the second internal volume;

a second cover portion comprising a panel member having a first end and a second end and at least one strap for securing and closing the device when the second cover portion is extended over the expandable sleeve portion;

wherein in the first position of use, the second cover portion is provided within the first volume, and wherein in the second position of use, the second cover portion comprises a cover for enclosing an upper portion of the expandable sleeve portion;

first and second shoulder straps connected to the device for supporting the weight of the device and its contents on a user;

the first and second shoulder straps comprising securing members having a first end and a second end, the first ends of the securing straps secured to the first and second shoulder straps and the second ends of the securing members selectively connectable to a main storage area of the device at a plurality of different locations.

13. The expandable luggage device of claim 12, wherein the first volume comprises a volume of between approximately 35 and 45 liters, and wherein the second volume comprises a volume of between approximately 50 and 60 liters.

14. The expandable luggage device of claim 12, wherein the first volume comprises a volume of between approximately 25 and 35 liters, and wherein the second storage volume comprises a volume of between approximately 35 and 45 liters.

15. The expandable luggage device of claim 12, wherein a panel portion of the luggage device comprises a top panel portion when the luggage device is provided in the first position of use and the panel portion comprises a rear panel portion when the luggage device is provided in the second position of use.

16. The expandable luggage device of claim 12, wherein the first and second shoulder straps comprise a first end and a second end, each of said first ends and said second ends interconnected to said luggage device.

17. The expandable luggage device of claim 16, wherein the first ends of the securing straps are secured to the first and second shoulder straps at a location between the first ends and the second ends of the shoulder straps.

18. The expandable luggage device of claim 12, wherein the securing straps comprise adjustable straps wherein at least a length of the securing straps is selectively adjustable.

19. The expandable luggage device of claim 12, wherein the panel member is provided within the first volume.

* * * * *